US007565998B2

(12) United States Patent
McClure

(10) Patent No.: US 7,565,998 B2
(45) Date of Patent: Jul. 28, 2009

(54) CONTAINER AND ASSOCIATED CONTAINER BLANK

(75) Inventor: Jack A McClure, Omaha, NE (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/618,341

(22) Filed: Dec. 29, 2006

(65) Prior Publication Data

US 2008/0156860 A1 Jul. 3, 2008

(51) Int. Cl.
*B65D 5/06* (2006.01)
*B65D 81/05* (2006.01)

(52) U.S. Cl. ..... 229/168; 206/591; 206/784; 229/178

(58) Field of Classification Search ..... 229/168, 229/172, 178, 904, 167; 206/562–565, 476, 206/486–489, 586, 591, 784
See application file for complete search history.

(56) References Cited

U.S. PATENT DOCUMENTS 1,996,965 A * 4/1935 Keppler ..... 229/169
2,847,152 A * 8/1958 Van Antwerpen ..... 206/591
2,963,211 A * 12/1960 Agler ..... 229/178
3,158,307 A * 11/1964 Mayer ..... 206/586
3,162,351 A * 12/1964 Rudofski ..... 206/586
3,545,666 A * 12/1970 Visvydas ..... 229/178
3,637,404 A * 1/1972 MacManus ..... 206/784
4,211,356 A * 7/1980 Tsuchiya et al. ..... 206/586
4,341,339 A * 7/1982 Zore ..... 229/167
4,369,913 A * 1/1983 Muise ..... 229/178
4,511,037 A * 4/1985 Lucous ..... 206/486
4,757,937 A * 7/1988 Maio et al. ..... 229/904
4,871,070 A * 10/1989 Langen et al. ..... 206/591
4,979,667 A * 12/1990 Seaman ..... 229/168
5,028,000 A * 7/1991 Chabot et al. ..... 229/178
5,277,360 A * 1/1994 DeMott ..... 229/178
5,361,975 A * 11/1994 Droste et al. ..... 229/178
5,501,339 A * 3/1996 Suzuki et al. ..... 206/586
6,513,705 B1 * 2/2003 Sheffer ..... 229/178
2004/0211825 A1 * 10/2004 Champion et al. ..... 229/178

* cited by examiner

*Primary Examiner*—Gary E Elkins

(57) ABSTRACT

The present invention is directed to a container and container blank for shipping and displaying product that are generally flat and round. In accordance with the present invention, a single sheet of foldable material is cut and scored to define a container blank. The blank includes a variety of panels, flaps and tabs, that when erected, form a container that includes an interior volume having gussets in the corners. The gusseted corners provide a contact surface for product stability within the container. Likewise, the gussets provide overall stability and increased strength to the container. The container includes top panels that close the container.

10 Claims, 5 Drawing Sheets

CONTAINER AND ASSOCIATED CONTAINER BLANK

FIELD OF THE INVENTION

This invention relates generally to cellulose-based blanks and containers and more specifically to wood cellulose-based blanks and containers used for shipping and displaying flat and round shaped objects.

BRIEF DESCRIPTION OF THE DRAWINGS

Various embodiments of this present invention are described in detail below with reference to the following drawings.

DETAILED DESCRIPTION OF THE INVENTION

The present invention will now be described with reference to the accompanying drawings. The present invention is directed to a container and associated blank that is configured to hold generally flat and round objects, such as, without limitation, packages of tortilla wraps or pizza crusts. One suitable embodiment of a container 50 constructed in accordance with aspects of the present invention is illustrated in FIGS. 1-5. Specific details of the blank 20 and resulting container 50 are described with more particularity below.

Figure 1:
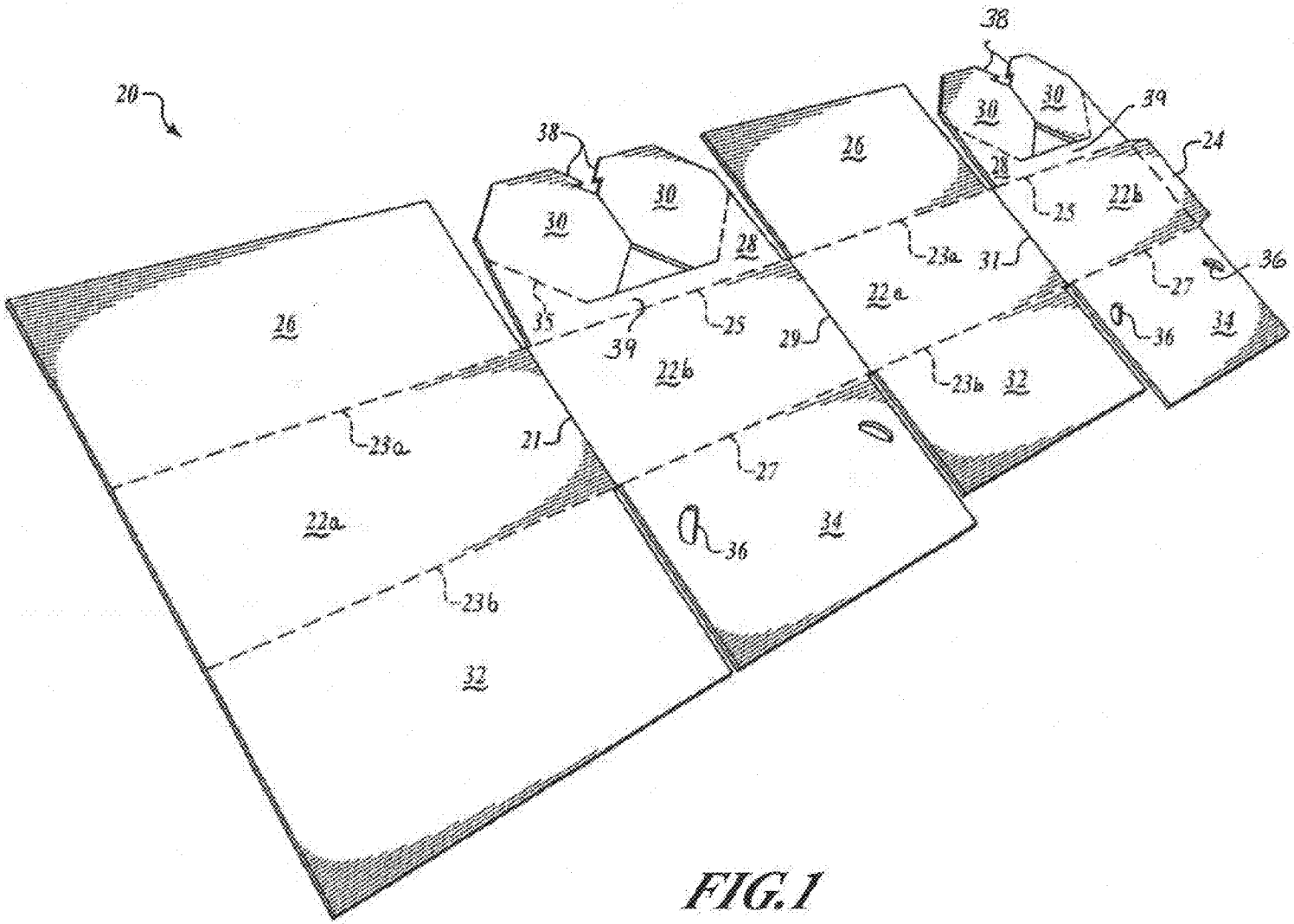
FIG. 1 is a perspective view of a single piece of container blank formed in accordance with an aspect of the present invention.
Figure 2:
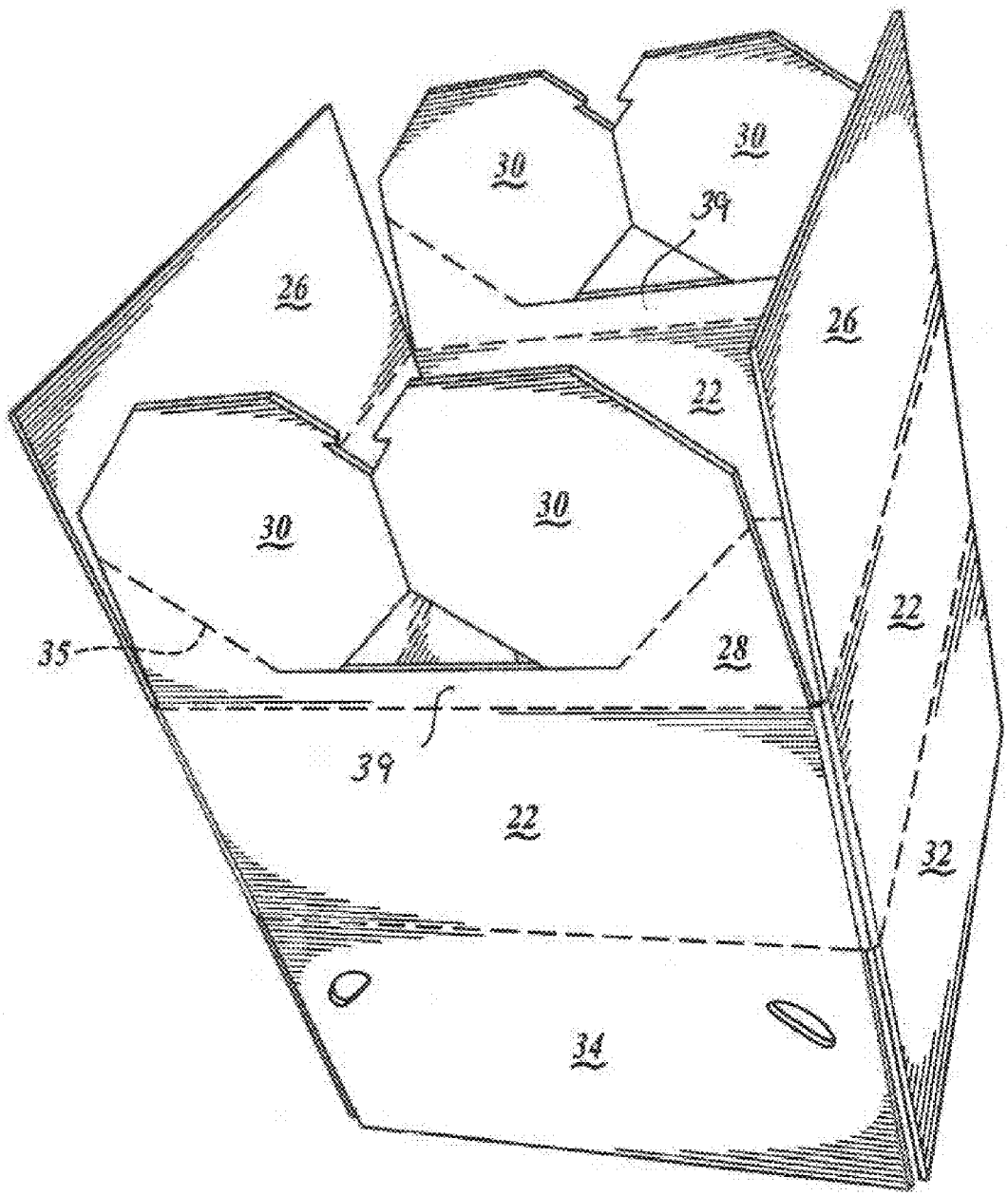
FIG. 2 is a perspective view of a partially assembled container assembly according to the present invention.
Figure 3:
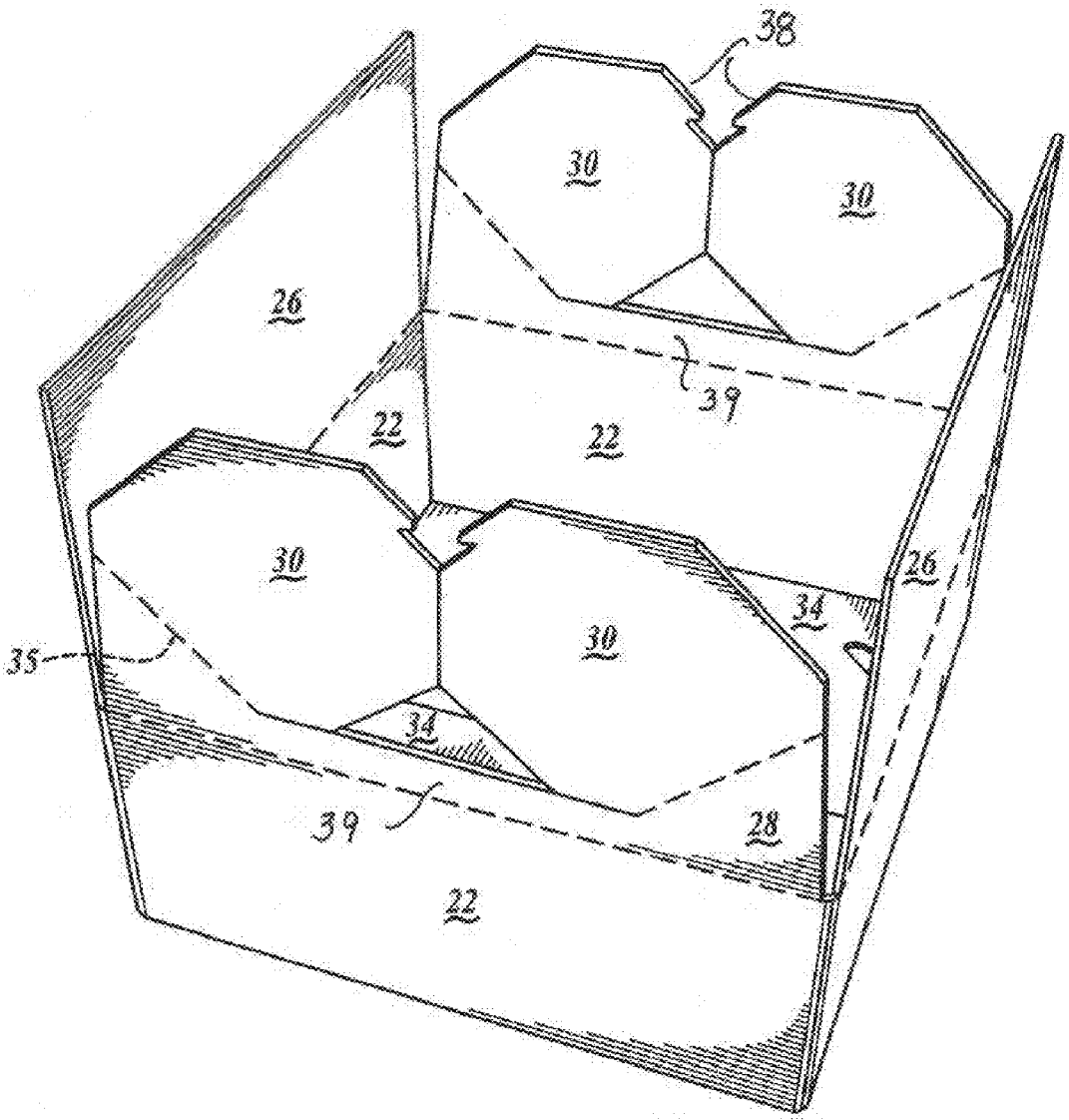
FIG. 3 is another perspective view of a further partially assembled container assembly according to the present invention.

FIG. 1 depicts a blank 20 used to form the container 50. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard.

The blank 20 is cut and scored, perforated or otherwise formed to include a plurality of panels that when assembled form container 50. In all FIGURES, like numbers indicate like parts. Additionally, cut lines are shown as solid lines, score lines as dashed lines, and lines of perforation as broken lines. For the purpose of further description herein, the downward direction is defined as the direction perpendicular to first bottom panel 32 that corresponds to the outer surface of the bottom panel when the container has been erected. The upward direction is defined as the direction perpendicular to the first bottom panel 32 that corresponds to the inner surface of the bottom panel when the container has been erected.

With respect to FIG. 1, the blank 20 includes first side panels 22*a*, second side panels 22*b*, first top panels 26 foldably attached to said first side panels, second top panels 28 foldably attached to said second side panels, and polygon shaped gusset panels 30 foldably attached to the second top panels. Further the blank 20 includes first bottom panels 32 and second bottom panels 34. The first side panels 22*a* are connected along fold lines 23*a* to respective first top panels 26 and also connected with a respective first bottom panel 32 along fold lines 23*b*. The second side panels 22*b* are connected to first side panels 22*a* along respective fold lines 21, 29 and 31, and to second bottom panels 34 along respective fold lines 27.

Opposite the fold lines 27 are fold lines 25, which connect second top panels 28 with respective adjacent second side panels 22*b*. The second top panels 28 include shaped gusset panels 30 attached to the second top panel 28 along respective fold lines 35 extending angularly with respect to the folded attachment of the gusset panel with the respective second top panel. As clearly shown in the drawings, it will be noted that the fold lines 35 extend angularly from a first end thereof at a respective adjacent outer side edge of the second top panel to a second end thereof spaced from the folded attachment of the second top panel to an associated second side panel, whereby the second top panel includes a narrow strip 39 extending between the gusset panels and their folded attachment with the second side panel.

As best seen in FIG. 1, the first bottom panels 32 are shown to be slightly different sizes. Specifically, as measured perpendicular to fold line 23, one first bottom panel is slightly longer than the other first bottom panel 32. However, it will be appreciated that this arrangement may be desired in situations where a certain overlap is desired on the bottom side of the container. However, it will also be appreciated that these first bottom panels may be of equal size, either with or without an overlap section. This configuration is within those skilled in the art and therefore will not be described in detail herein.

With respect to FIGS. 2-5, erection of the container 50 from the blank 20 is depicted. Initially, the various side panels 22 are folded around fold lines 21, 29, 31, respectively, such that the manufacturer's panel 24 is brought juxtaposed a portion of one of the side panels 22. The manufacturer's panel 24 may then be joined to the respective side panel 22 in any methods such as staples, brads, tacks, adhesives or tapes such that the panels are held to the extent needed. As can best be seen in FIG. 2, this will form a substantially rectangular-shaped tube.

As the box erection process continues, the second bottom panels 34 may be folded inwardly approximately 90 degrees along fold lines 27. Subsequently, the first bottom panels 32 may be folded inwardly 90 degrees along fold lines 23. These respective bottom panels may then be joined together in any manner discussed above, or left not joined. As depicted best in FIG. 3, you may see that the first top panels 26 and the second top panels 28 still stand vertically, and the container 50 is in a generally open, yet not fully formed, condition.

Figure 4:
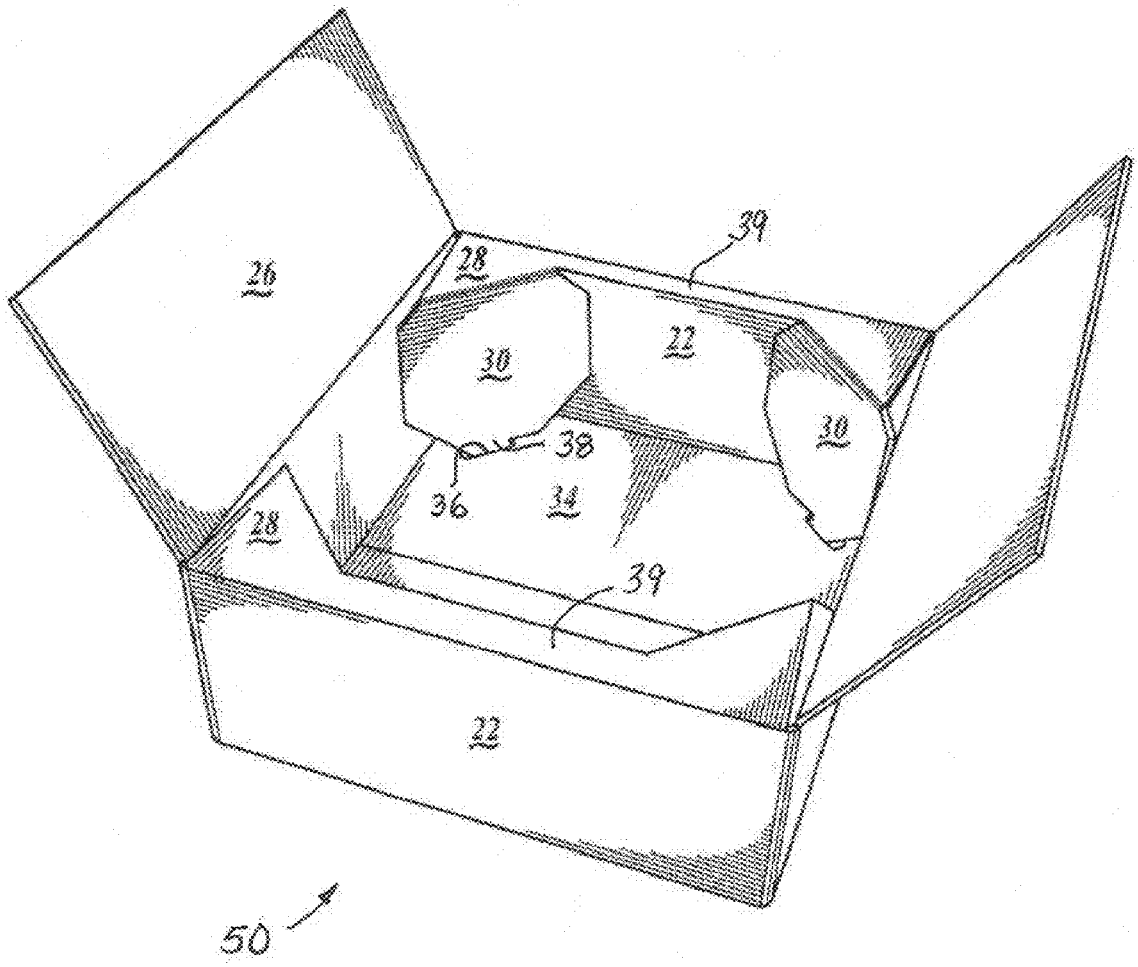
FIG. 4 is a perspective view of a still further partially assembled container assembly according to the present invention; and, FIG. 5 is a perspective view of an assembled container from the blank of FIG. 1, ready for receipt of product.

With reference to FIG. 4, the second top panels 28 are folded inwardly approximately 90 degrees along a fold line 25 such that the second top panels 28 lies in a substantially parallel plane to the first bottom panel 32 and second bottom panel 34. Subsequently, each of the gusset panels 30 may be folded downwardly approximately 90 degrees along fold lines 35. The tabs 38 may then be inserted into the slots 36 to substantially lock these respective container portions in place. This stage of erection is depicted in FIG. 4. At this stage, the container 50 is ready to accept product (not shown). Products such as tortillas or other substantially round and generally flat objects may be placed within this box. The gussets panels 30 provide contact points for the products (not shown) and to help keep the product positioned where desired within the container 50. Additionally, the gusset panels 30 increase overall container 50 stability and strength.

Figure 5:
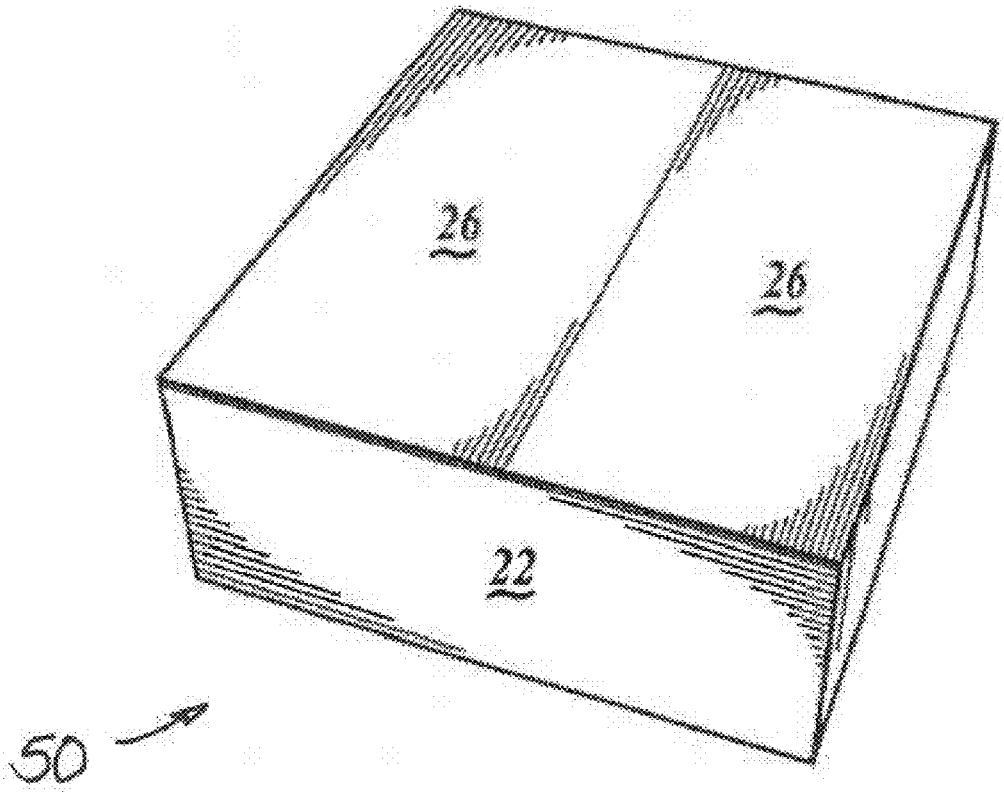

FIG. 5 simply depicts the container 50 in its closed state. Specifically, the first top panels are folded approximately 90 degrees inwardly along fold lines 23. The container 50 may then be sealed by tape, adhesive, staples, braids, or combinations thereof.

The container 50 as shown is simple to manufacture, easy to assemble and may be a design of considerable usage in stores when the need for shipping or even displaying products having a substantially flat, yet round, geometry. However, it will be appreciated that this design may also be used in other a variety of other retail or wholesale environments or product configurations.

Any variety of additional elements may be included, such as, without limitation, vents, specialized liners or grease barriers, etc., without departing from the spirit and scope of the present invention. Similarly, rounding or otherwise trimming the various panels is considered within the scope of the instant invention.

While various embodiments of this invention have been illustrated and described, as noted above, many changes can be made without departing from the spirit and scope of this invention. Accordingly, the scope of this invention is not limited by the disclosure of the various embodiments. Instead, the invention should be determined entirely by references to the claims that follow.

What is claimed is:

1. A container having a top, a bottom, and opposite sides, comprising:

a plurality of side panels having top, bottom and side edges and foldably joined together along said side edges;

first bottom panels foldably attached to the bottom edges of a first pair of opposed said side panels;

second bottom panels foldably attached to the bottom edges of a second pair of opposed said side panels, said first and second bottom panels folded inwardly over said container bottom;

first top panels foldably attached to the top edges of said first pair of opposed said side panels;

second top panels foldably attached to the top edges of said second pair of opposed said side panels; and an outer end edge of each of said second top panels opposite its folded attachment with an associated said side panel is cut and scored to define a pair of hexagonally shaped corner gusset panels each foldably joined along an angularly extending fold line to a respective one of said second top panels, said second top panels folded inwardly over the top of the container in generally parallel spaced relationship to said bottom panels, and said gusset panels folded downwardly about said angularly extending fold lines to extend downwardly into said container from said inwardly folded second top panels to said container bottom and diagonally across interior corners of the container, with one side edge of each gusset panel lying against one side panel and an opposite side edge of each gusset panel lying against an adjacent side panel, said gusset panels and side panels forming a perimeter support for objects placed in the container and preventing migration of the objects into corners of the container.

2. The container of claim 1, wherein the container is made from a single sheet of foldable material formed from a cellulose-based material.

3. The container of claim 2, wherein the cellulose-based material is formed from at least one of a wood pulp, straw, cotton, and bagasse.

4. The container of claim 2, wherein the cellulose-based material is in the form of at least one of a fiberboard, containerboard, corrugated containerboard and paperboard.

5. A container as claimed in claim 1, wherein:

each of said second bottom panels has a slot cut-out; and a tab on a bottom edge of each said gusset panel is received in a respective slot cut-out to hold said gusset panels in erected position.

6. A container as claimed in claim 1, wherein:

a portion of each said second top panel between said gusset panels and the folded attachment of said second top panel to an associated said side panel forms a partial top closure adjacent an associated said side panel, covering the space between said gusset panels and an adjacent corner of the container.

7. A container as claimed in claim 5, wherein:

a portion of each said second top panel between said gusset panels and the folded attachment of said second top panel to an associated said side panel forms a partial top closure adjacent an associated said side panel.

8. A one-piece blank of foldable material for making a container having a bottom wall, side walls, and interior diagonal corner panels, comprising:

first and second side panels foldably attached to one another along adjacent side edges, said first and second side panels having top edges and bottom edges;

a first bottom panel foldably attached to the bottom edge of a respective said first side panel, and a second bottom panel foldably attached to the bottom edge of a respective said second side panel; and a first top panel foldably attached to the top edge of a respective one of each of said first side panels, and a second top panel foldably attached to the top edge of a respective one of each of said second side panels, said second top panels each having an outer end edge opposite its folded attachment to a respective said second side panel, and a plurality of cuts and scores in each said second top panel defining a polygonal gusset panel at each of the opposite corners of the outer end edge of each said second top panel, each said gusset panel joined to said second top panel along a fold line extending angularly from a first end thereof at a respective adjacent outer side edge of said second top panel to a second end thereof spaced from the folded attachment of said second top panel to an associated said second side panel, whereby a narrow strip of said second top panel extends between said gusset panels and said folded attachment of said second top panel to an associated said second side panel.

9. A blank as claimed in claim 8, wherein:

a slot cut-out is formed in each said second bottom panel; and a tab is on an edge of each said gusset panel opposite its folded attachment to a respective said second top panel.

10. A blank as claimed in claim 9, wherein:

said gusset panels are hexagonal in shape.

* * * * *